US005358222A

United States Patent [19]

Kaasinen et al.

[11] Patent Number: 5,358,222

[45] Date of Patent: Oct. 25, 1994

[54] APPARATUS FOR OXIDIZING PULVEROUS FUEL WITH TWO GASES HAVING DIFFERENT OXYGEN CONTENTS

[75] Inventors: Pentti J. Kaasinen, Harjavalta; Launo L. Lilja; Valto J. Mäkitalo, both of Pori; Lasse J. Valli, Harjavalta, all of Finland

[73] Assignee: Outokumpu Engineering Contractors Oy, Espoo, Finland

[21] Appl. No.: 68,980

[22] Filed: May 28, 1993

[30] Foreign Application Priority Data

Jun. 1, 1992 [FI] Finland ..... 922532

[51] Int. Cl.[5] ..... C22B 5/12

[52] U.S. Cl. ..... 266/135; 266/182

[58] Field of Search ..... 266/182, 135, 47, 219, 266/269, 135, 182; 75/639, 629, 455

[56] References Cited

U.S. PATENT DOCUMENTS 3,118,758 1/1964 Ross ..... 75/455

*Primary Examiner*—Melvyn J. Andrews

*Attorney, Agent, or Firm*—Brooks Haidt Haffner & Delahunty

[57] ABSTRACT

The invention relates to a method for oxidizing the pulverous fuel of a furnace, advantageously a flash smelting furnace, by means of a burner, so that the oxidation takes place mainly owing to an effective mixing of two different combustion gases, pulverous fuel and possibly an extra fuel in the furnace space. The combustion gases are conducted into the furnace space in separate flows, so that oxygen is fed in through the center in an at least partly turbulent flow, and the air is fed around it in several separate flows. The invention also relates to a burner for mixing pulverous fuel and combustion gas and for burning them in the said furnace space.

9 Claims, 4 Drawing Sheets

Fig. 4
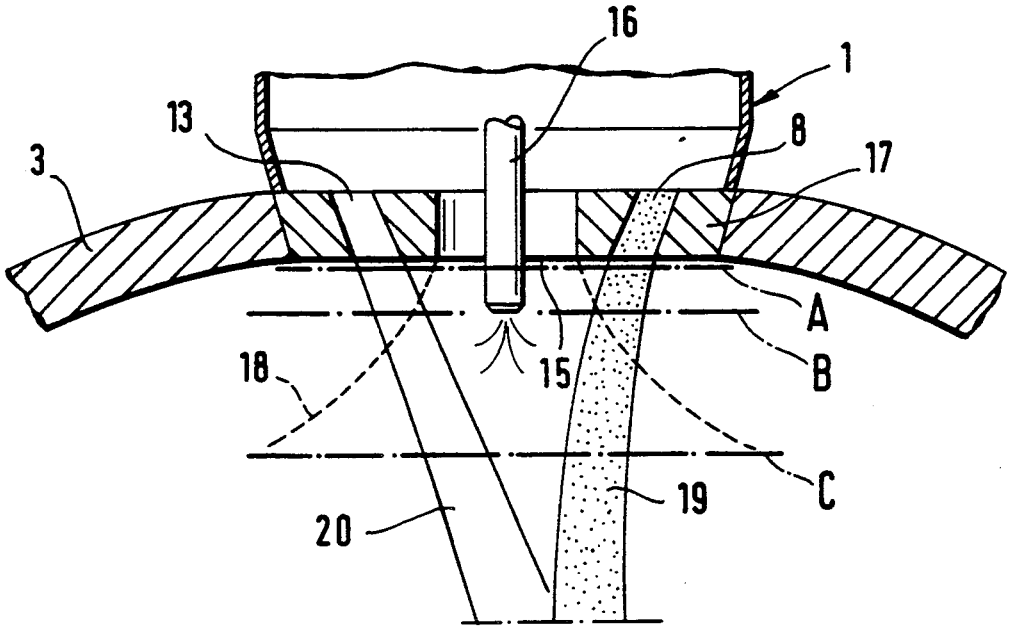
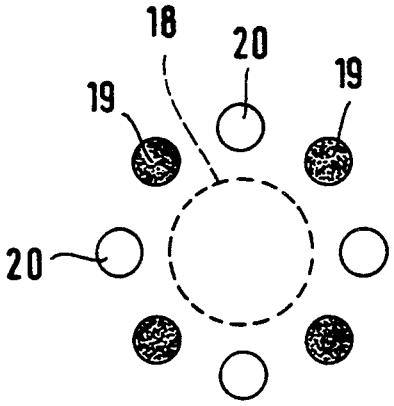
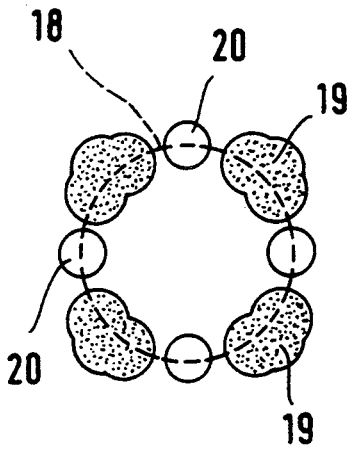
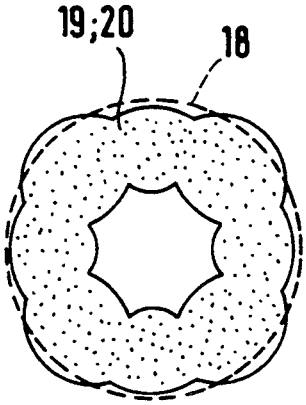
Fig. 4A Fig. 4B Fig. 4C

APPARATUS FOR OXIDIZING PULVEROUS FUEL WITH TWO GASES HAVING DIFFERENT OXYGEN CONTENTS

BACKGROUND OF THE INVENTION

The invention relates to a method for oxidizing a pulverous fuel for a furnace, advantageously a flash smelting furnace, by means of a burner, in which case the oxidation takes place mainly owing to an effective mixing of two different combustion gases, the pulverous fuel and a possible extra fuel in the furnace space. The combustion gases are conducted into the furnace space in separate flows, so that oxygen is supplied centrally in an at least partly turbulent state, and air is fed in around it in several separate flows. The invention also relates to a burner for mixing pulverous fuel and combustion gas and for burning them in the said furnace space.

In the prior art there are known several ways for oxidizing pulverous fuel both with air, oxygen-enriched air and pure oxygen.

In the U.S. Pat. No. 4,210,315, a powdery substance is distributed as an annular, downwardly directed powder flow, which on a specially shaped surface disposed within the annular flow is directed and at the same time symmetrically distributed sideways by utilizing the dispersion air jets discharged from underneath the shaped surface. From around this suspension flow, still in a mainly annular flow, the combustion gas is conducted to be mixed into and to react with the powdery substance.

A typical requirement for combustion taking place in a cylindrical vertical shaft is that the powder-combustion gas jet must be parallel to the shaft and symmetrical with respect thereto, and this is realized for instance in the U.S. Pat. No. 4,392,885. There a mainly horizontally proceeding combustion gas is divided into an smooth, annular flow and turned to encircle the said pulverous flow in parallel direction to the reaction shaft.

Sometimes, when the annular combustion gas flow becomes too "thin", it must be conducted in spray-like sub-flows to encircle the above said pulverous flow and to be mixed thereto, like in the U.S. Pat. No. 4,490,170. The separate combustion gas jets are advantageously made to rotate.

In all these, the combustion gas comes from around a uniform pulverous flow either as a uniform annular flow or as separate jets.

As a difference with respect to the preceding examples, in the U.S. Pat. No. 4,331,087 the uniformly annular pulverous flow is, however, made to encircle a powerfully rotating combustion gas jet.

In the U.S. Pat. No. 5,133,801, a small amount of the oxygen is conducted in the center of the distribution member described in the U.S. Pat. No. 4,210,315 to supply extra oxygen from inside the pulverous flow.

In many cases, for instance while burning carbon, the pulverous fuel and combustion gas are mixed already before the reaction space, even before the burner proper. However, this does not always succeed, particularly if the employed combustion gas is pure oxygen and the fuel is some easily reacting pulverous substance. Wearing of the equipment also causes difficulties in this case.

In the present invention the drawbacks of the above mentioned patents are overcome, and consequently the idea is realized in practice, too.

The method and apparatus of the invention is explained in more detail below, with reference to the appended drawings, where

BRIEF DESCRIPTION OF THE DRAWINGS

FIG. 4 is a schematical illustration of how the separate material flows are mixed in the top part of the flash smelting furnace.

FIGS. 4A, 4B and 4C represent sectional views taken along lines A, B and C of the illustration.

DETAILED DESCRIPTION OF PREFERRED EMBODIMENT

Figure 1:
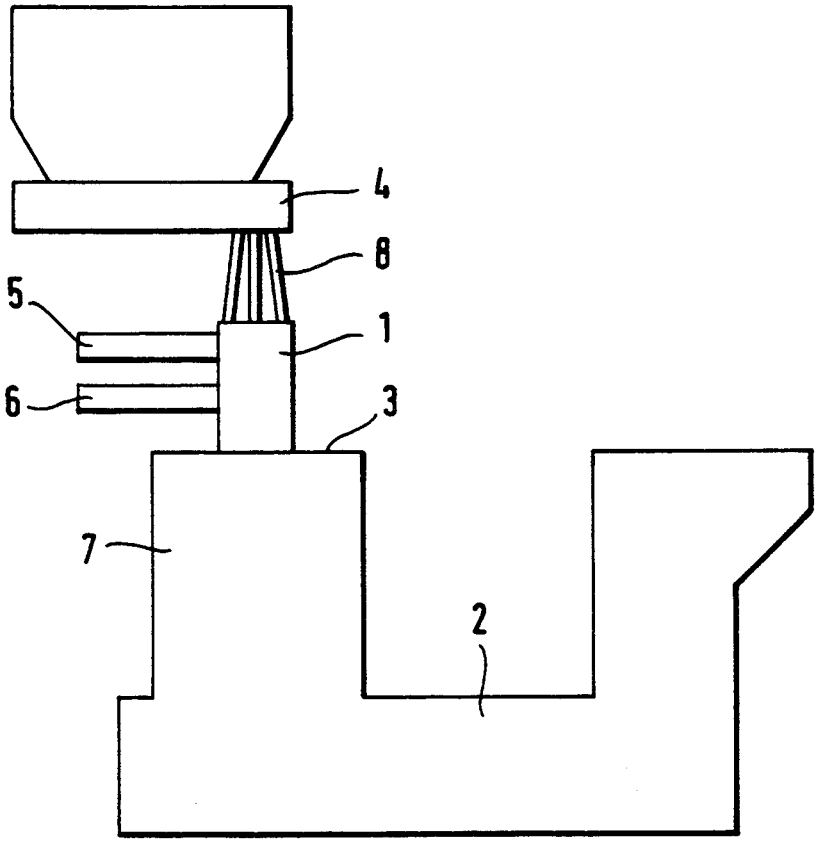
FIG. 1 is a schematical illustration of a preferred embodiment of the invention, a flash smelting furnace.

FIG. 1 is a schematical illustration of how the burner 1 of pulverous substance is located in the arch 3 of the flash smelting furnace 2. The pulverous fuel flow, generally concentrate flow, is divided into several sub-flows from the supply device 4 inside the burner. Both reaction gases 5 and 6 are also brought in uniform gas flows onto the burner, where air is distributed to pass in several sub-flows into the furnace. The concentrate and the reaction gases are conducted into the furnace in separate flows, so that they meet only in the reaction shaft 7 of the flash smelting furnace. The present invention deals with two different reaction gases, and accordingly reaction gas I means oxygen gas and reaction gas II means air.

Figure 2:
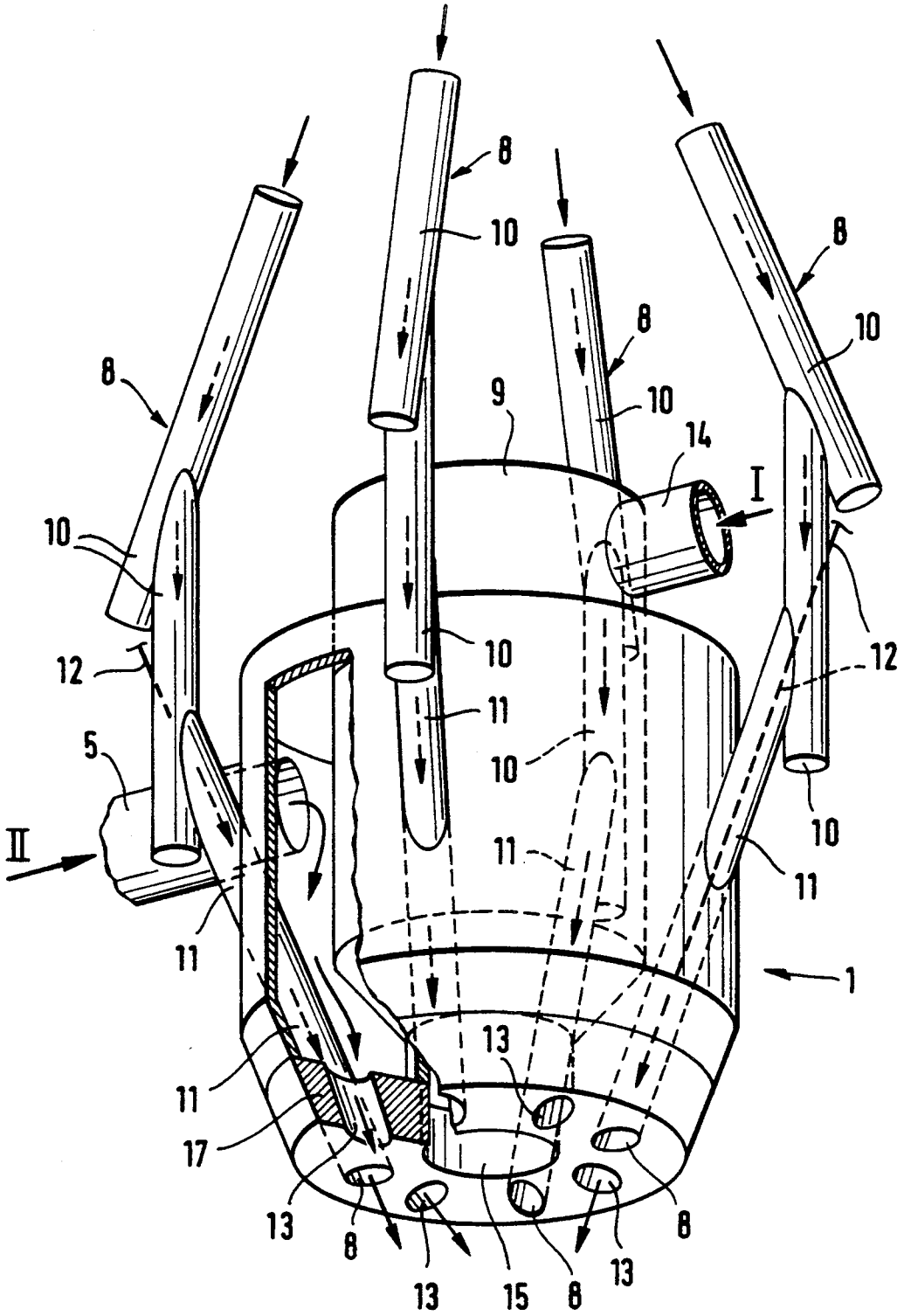
FIG. 2 is a diagonally axonometeric view of a preferred embodiment of the pulverous material burner of the invention, seen in partial cross-section.

The pulverous concentrate flow is distributed from the supply device 4, which often is a drag conveyor, divided into 3 . . . 6, advantageously four sub-flows. As is seen in FIG. 2, these sub-flows are allowed to fall in the mainly tubular channels 8 of the burner downwards by gravitation. First the direction of the sub-flows is in practice directed outwards to such an extent that a vortex generating assembly 9 can be installed in the central part of the apparatus. Thereafter the sub-flows remain vertical for a certain time and then turn inwards, so that they are directed towards the central axis of a vertical, cylindrical reaction shaft 7, forming an angle with the shaft, which angle is in the region of 15° . . . 50°, and finally the sub-flows of pulverous fuel flowing in the channels 8 are discharged, through the arch 3 of the reaction shaft, from around the vortex generator of reaction gas I to the shaft 7 itself, meeting on the central axis of the shaft, somewhat below the lower surface of the arch.

FIG. 2 also shows that the tubular channels 8 constructed for conveying the concentrate are at the bends provided with special pockets 10, whereto the concentrate is gathered and thus forms an autogenous lining therein. This autogenous lining protects the tube of impact-like effects of single particles. The bottom part 11 of the channels 8 can further be provided with separate scraping means 12, whereby buildups can be scraped off the concentrate tube and the arch during operation.

In the burning of pulverous materials, particularly concentrate, there is used both air and pure oxygen. A normal method is to mix them homogeneously before the reaction space and then conduct the created oxygen-enriched air to the reaction shaft for instance in the manner described in the above mentioned patents. Difficulties may sometimes arise in the mixing. Often for example oxygen and air have different pressures, and this must be taken into account while planning the method of mixing and conducting the gases into the furnace.

In the method of the invention, oxygen and air are conducted into the furnace separately and according to different methods. In practice this means that air is generally conducted to the furnace through a blower, so that the air pressure is in the region 0.02–0.05 bar. Oxygen is conducted through a compressor, and the oxygen pressure is in the region 0.2–0.5 bar. According to the present invention, these combustion gases are now conducted separately into the furnace, in which case the higher pressure of oxygen, for instance, can be fully utilized in dispersing the concentrate, so that this agitation energy contained in oxygen is not lost in the mixing of the combustion gases together.

According to the present invention, all pressure obtained for the combustion gases is utilized in an optimal fashion. The oxygen pressure can be used for achieving strong turbulence for the oxygen, and hence good distribution for the concentrate. The fluctuation in the oxygen quantity is taken into account by means of a special turbulence adjusting member, which is described for instance in the U.S. Pat. No. 4,331,087.

On the other hand, strong turbulence and concentrate distribution is not required of air, owing to its low pressure, but a suitable, widely variable "sturdyness".

To the burner 1 reaction gas II, i.e. air, comes mainly horizontally, and it is divided, in similar fashion as the concentrate, into 3–6, advantageously four sub-flows. The division may take place prior to changing the horizontal direction to mainly vertical direction, or in a separate air distribution chamber, the bottom part whereof is provided with mainly tubular apertures 13 extending through the arch of the reaction shaft and directed at an essentially equal angle as the concentrate flow. Advantageously the concentrate and air channels 8 and 13 are located on the same circle, so that every second channel is reserved for concentrate and every second for air. In principle the central axes of both sub-flows meet at the same point on the central axis of the shaft.

However, the opening angle of the air jets is, as is generally known, 15°–20°, and they set the surrounding medium, such as concentrate, into a suction current which is most forcefully directed to the upper part of the jet. Thus the surrounding medium gets into an intensive contact with the air jet, naturally depending on velocities.

Reaction gas I, i.e. the oxygen proper, the share of which in the whole fuel gas flow is roughly half, is conducted as a uniform, first mainly horizontal flow through the pipe 14 to the vortex generating chamber 9. In the vortex generating chamber, the oxygen gas flow is turned to an essentially vertical direction and set, at least partly, to a strong turbulent motion, so that the oxygen is made to be discharged from the center of the said air and concentrate suspension ring as a mainly hollow conical jet, with an opening angle of over 20°, from the bottom part 15 of the vortex generator to the reaction shaft 7. In addition to what was already said of the advantages of a separate oxygen supply, it is maintained that separate oxygen channels are an important factor also with respect to safety at work.

Figure 3:
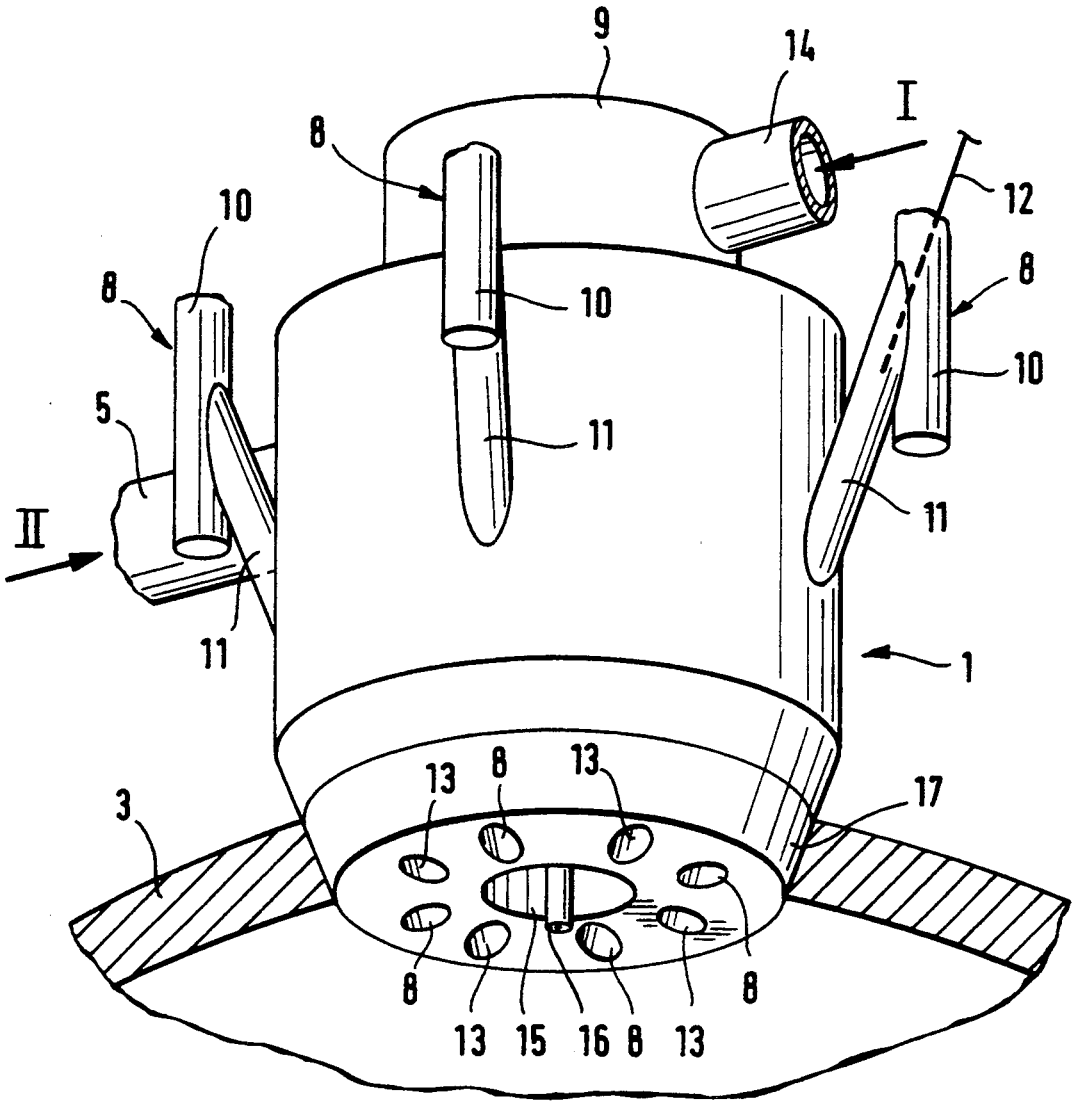
FIG. 3 is a diagonally axonometric view of a preferred embodiment of a burner of the invention seen in partial cross-section from underneath.

There are concentrates, such as nickel sulfide concentrate for instance, whose own sulfur content is not always sufficient for maintaining the high temperature required by the reactions. In these cases, additional heat is needed in the reaction shaft. In the present invention this is easily achieved by means of the following procedure. FIG. 3 illustrates how from inside the oxygen flow discharged from the bottom part 15 of the vortex generator, there is conducted to the reaction shaft some liquid fuel through the pipe 16, so that this flow of extra fuel is dispersed from inside to the hollow oxygen gas flow, and when the fuel burns due to the effect of the surrounding oxygen, it emits the additional heat required in the reactions.

In order to fulfil all the above enlisted requirements, the measurements often result in a situation where the surfaces of the burner elements extending through the arch of the reaction shaft become so large, that owing to the intensive heat radiation in the furnace (temperature about 1,400° C.) the resistance of the burner material is no longer guaranteed. In the present invention this problem is solved in an efficient fashion which is not always obvious even for someone skilled in the art, because of the risks connected to cooling by water. According to the present invention, the whole burner system is installed in the arch, "inside" a water-cooled copper plate 17, which makes the choosing of materials and designs remarkably easier.

FIG. 4 is a schematical illustration of the situation in the top part of the reaction shaft, when the fuel and combustion gas jets discharged from separate channels meet. The situation at points A, B and C is described in corresponding cross-sections below.

In the vertical cross-section of FIG. 4 it is seen that from the bottom part 15 of the vortex generator there is discharged a separate strong oxygen gas jet 18, around which there are symmetrically emitted the concentrate flows 19 coming from the concentrate channels 8 and the air flows 20 coming from the air channels 13. In the situation of the cross-section 4A, all flows are still separate, but as is apparent from the cross-section 4B, the opening angle of the air jets sets the concentrate flow in a suction current, owing to which the finest element of the concentrate that is fluidized in the gas space is absorbed in the air jet and hence does not stick and grow buildups on the arch. There is thus created an inwards directed annular concentrate-air curtain, and the concentrate content in the ring fluctuates in a wave-like fashion. As is apparent from the cross-section 4C, the turbulence of the oxygen jet is so strong that it is still capable of distributing the presuspended concentrate-air suspension visible in FIG. 4B, and to be mixed therein homogeneously, at a sufficiently high velocity required for the reaction.

It is maintained that some prior art burners may have succeeded in achieving certain features typical of the present invention, whereas the realization of some other features essential for the combustion process has remained weaker; now the method and apparatus of the present invention overcomes all of the above enlisted drawbacks simultaneously. Important issues for the burner are practical demands, i.e. operation without blocking, without wearing etc.

In all the described prior art cases the concentrate flow is made annular, in which case the aperture often becomes relatively small and causes a danger of blocking, for instance owing to some unsuitable object carried along with the concentrate flow (e.g. welding electrode). The aperture may also, particularly when heated, easily become narrower at some point and thus cause asymmetry. The cleaning of an annular aperture often is a problem, too. Repairing a damaged aperture requires separately planned and manually made special structures.

In the apparatus of the present invention, there can be employed standard pipes, which are thus easily replaceable, solid and maintain their shape well. It is also well known that a round transversal surface has least friction-causing wall surface, so that blocking is minimal. If, however, blocking should happen for some reason, we have a possibility for cleaning, which is realized in a very simple and easily manageable way compared to many other structures, and which can even be automated if necessary.

The concentrates often cause wearing when colliding to the wall at a fairly high speed. In the present invention this is taken care of in an autogenous fashion, i.e. at each collision spot, there is arranged a continuation for the pipe, which at the same time serves as the gathering vessel of the concentrate and receives the collision impacts of the concentrate flow, as was described above.

In many cases where the oxygen comes from around the concentrate, the additional heat is given from the intermediate space in between the concentrate-fuel air flow and the reaction shaft wall, and then a hot flame (oxygen) cannot generally be used owing to the wearing of the shaft wall due to heat strain. In the present invention, the concentrate-air suspension is located nearest to the wall, and therefore the structure of the invention does not cause danger to the brickwork or mortar structures of the shaft.

The invention is further described with reference to the appended example:

EXAMPLE 1

In the flash smelting of a nickel concentrate, the following materials were fed into the furnace according to the table below. The diameter of the reaction shaft was 4.2 m.

| | Capacity I | Capacity II |
|---|---|---|
| Total supply (concentrate + additions) | 15 t/h | 30 t/h |
| Oxygen ($V_{02n}$) | 2,500 $m^3/h$ | 5,000 $m^3/h$ |
| Combustion air ($V_{in}$) | 2,000 $m^3/h$ | 3,000 $m^3/h$ |
| Oxygen pressure | 0.25 bar | 0.26 bar |
| Combustion air pressure | 0.015 bar | 0.03 bar |
| Oil | 300 l/h | 300 l/h |

As is seen in the table above, the adjusting range of the burner is wide; the capacity can be doubled, and practice has shown that the burner works efficiently in both regions. As is seen in the table, in the region of capacity II the oxygen supply was doubled as well as the total supply, but the same mixing efficiency (turbulence rate) was achieved by reducing the intensity of the circulation of combustion gas I. The adjusting range is clearly wider that that achieved previously by using prior art arrangements, because in those the mixing efficiency was largely dependent on the discharge velocity of the premixed combustion gas. In the example it is seen that the feeding of combustion gases I and II separately brings forth an essential extension in the adjusting range.

We claim:

1. A burner for use in oxidizing pulverous fuel to be fed into a flash smelting furnace of the type having a vertical cylindrical reaction shaft and an arch at the top of the reaction shaft through which arch reaction gases and the pulverous fuel are fed to the reaction shaft, the burner comprising: a central vortex generating chamber and a pipe for feeding oxygen as a first reaction gas to said vortex generating chamber, said vortex generating chamber comprising means for creating a turbulent flow of said oxygen and for discharging the turbulent oxygen flow downwardly from the vortex generating chamber through a bottom part of the burner; a first plurality of tubular channels passing around the vortex generating chamber for feeding air as a second reaction gas to and through air openings located at spaced positions arranged in a circle surrounding said oxygen discharging means; and another plurality of tubular channels passing around the vortex generating chamber for feeding pulverous fuel to and through fuel openings located at spaced positions between the air openings on the same circle as the air openings whereby said air and fuel openings form a ring around said oxygen discharge means.

2. An apparatus according to claim 1 wherein the bottom part of the burner is located within a water-cooled copper plate.

3. An apparatus according to claim 1 wherein the vortex generating chamber is generally cylindrical and inside the vortex generating chamber there is a supply pipe for a gaseous or liquid extra fuel which supply pipe is coaxial with the axis of said generally cylindrical vortex generating chamber.

4. An apparatus according to claim 1 wherein each channel for feeding pulverous fuel has at least one bend provided with means for protecting the channel from impacts of the pulverous material against the channel.

5. An apparatus according to claim 1 wherein the channels for feeding pulverous fuel are provided with scraping means for scraping fuel particles off the tubular channel.

6. An apparatus according to claim 1 wherein tubular channels for feeding air form an angle of 15°–20° with a line drawn perpendicularly through the center of the disc defined by said circle.

7. An apparatus according to claim 1 wherein the tubular channels for feeding pulverous fuel form an angle of 15°–50° with a line drawn perpendicularly through the center of the disc defined by said circle.

8. An apparatus according to claim 1 wherein the number of the channels for feeding air is 4–6.

9. An apparatus according to claim 1 wherein the number of the channels for feeding the pulverous fuel is 4–6.

* * * * *